US010982897B2

(12) United States Patent
Reuter

(10) Patent No.: US 10,982,897 B2
(45) Date of Patent: Apr. 20, 2021

(54) APPLIANCE HAVING AN ARTICULATING MULLION AND DAMPING ASSEMBLY

(71) Applicant: Haier US Appliance Solutions, Inc., Wilmington, DE (US)

(72) Inventor: Daryl Lee Reuter, Evansville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 8 days.

(21) Appl. No.: 16/373,846

(22) Filed: Apr. 3, 2019

(65) Prior Publication Data

US 2020/0318889 A1 Oct. 8, 2020

(51) Int. Cl.

| | |
|---|---|
| ***F25D 23/08*** | (2006.01) |
| ***F25D 11/02*** | (2006.01) |
| ***F25D 23/02*** | (2006.01) |

(52) U.S. Cl.

CPC ..... *F25D 23/087* (2013.01); *F25D 11/02* (2013.01); *F25D 23/028* (2013.01); *F25D 2323/021* (2013.01); *F25D 2323/024* (2013.01); *F25D 2400/06* (2013.01)

(58) Field of Classification Search

CPC .... F25D 23/087; F25D 2400/06; F25D 23/02; F25D 23/028; F25D 2323/021; F25D 21/04; F25D 23/069; F25D 2400/04; F25D 23/025; F25D 11/02; F25D 2323/024; E06B 7/215

See application file for complete search history.

(56) References Cited

U.S. PATENT DOCUMENTS

| | | | | |
|---|---|---|---|---|
| 4,711,098 | A * | 12/1987 | Kuwabara | F25D 11/022 312/321.5 |
| 5,411,328 | A * | 5/1995 | You | F25D 23/028 312/405 |
| 5,694,789 | A * | 12/1997 | Do | F25D 23/02 312/405 |
| 9,127,876 | B2 | 9/2015 | Wilson et al. | |
| 9,234,695 | B1 * | 1/2016 | Dubina | F25D 23/025 |
| 9,995,528 | B1 * | 6/2018 | Ebrom | F25D 29/00 |
| 2014/0265804 | A1 * | 9/2014 | Wilson | F25D 23/028 312/405 |
| 2019/0049170 | A1 * | 2/2019 | Reuter | F25D 23/028 |

FOREIGN PATENT DOCUMENTS

| | | | | |
|---|---|---|---|---|
| EP | 2450652 | A2 * | 5/2012 | F25D 23/028 |
| EP | 2580549 | B1 | 9/2014 | |
| JP | 7248178 | A | 9/1995 | |
| JP | 2000304419 | A | 11/2000 | |

* cited by examiner

*Primary Examiner* — Hiwot E Tefera
(74) *Attorney, Agent, or Firm* — Dority & Manning, P.A.

(57) ABSTRACT

An appliance may include a cabinet, a door, a mullion, and a damping assembly. The cabinet may define a chamber. The door may be coupled to the cabinet and rotatable between an open position and a closed position to selectively seal the chamber. The mullion may have an inner face and an outer face. The mullion may be rotatably coupled to the door via a hinge defining an axial direction between a first position and a second position. The damping assembly may include a stopper wedge and a mated wedge. The stopper wedge may be fixed to the door. The stopper wedge may have a primary face extending along a nonparallel angle relative to the longitudinal plane. The mated wedge may be fixed to the mullion. The mated wedge may have a receiving face complementary to the primary face of the stopper wedge to engage therewith in the first position.

18 Claims, 12 Drawing Sheets

APPLIANCE HAVING AN ARTICULATING MULLION AND DAMPING ASSEMBLY

FIELD OF THE INVENTION

The present subject matter relates generally to appliances, such as refrigerator appliances, having an articulating mullion for sealing one or more doors.

BACKGROUND OF THE INVENTION

Appliances, such as refrigerator appliances, often include one or more assemblies for sealing air therein. In the case of refrigerator appliances, one of the reasons for such a seal is to mitigate food spoilage, which presents significant health hazards and causes billions of dollars of waste around the world each year. Specifically, in order to prevent spoilage, refrigerators and freezers maintain foods at low temperatures. Properly sealing in the cold air while still allowing the consumer to easily access the freezer and fresh food compartments is one of the most important considerations in refrigerator design.

Many refrigerators provide one or more hinged doors for accessing the refrigerator cabinet. The doors generally include gaskets, which seal the door against the refrigerator cabinet when the door is closed. French-style doors are desirable because they reduce the weight load on the door hinge. French doors divide the cabinet opening in two, such that each door weighs less than a single door would weigh. That allows the size of the support structure of each door to be reduced. French doors also increase accessibility to the refrigerator cabinet and provide additional storage arrangements that are not possible with a single-door design.

However, one problem with French doors is that they require additional seals; in particular, the middle of the refrigerator opening (i.e., where the two doors meet) must maintain a seal when the doors are closed. One solution to that problem is to position a stationary vertical mullion bar in the middle of the opening, upon which each door can create a seal. A stationary mullion limits the size of items that can be put into the refrigerator. Some French door refrigerators include a movable mullion attached to one of the doors such that access to the corresponding compartment via the respective opening is not obstructed by the mullion when the door to which the mullion is attached is opened. However, in some instances, the movable mullion may become misaligned and, as a result, may impair the sealing engagement of the doors or may inhibit the doors from opening or closing.

Accordingly, it would be useful to provide an appliance addressing one or more of the above issues. In particular, it may be advantageous to provide an appliance having an appliance having one or more features for maintaining a mullion in a correct position or alignment.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an appliance is provided. The appliance may include a cabinet, a door, a mullion, and a damping assembly. The cabinet may define a chamber. The door may be coupled to the cabinet and rotatable between an open position and a closed position to selectively seal the chamber. The door may have a perimeter edge defining a longitudinal plane. The mullion may have an inner face and an outer face. The mullion may be rotatably coupled to the door via a hinge defining an axial direction parallel to the longitudinal plane. The mullion may be rotatable about the axial direction between a first position and a second position. The damping assembly may be formed between the door and the mullion. The damping assembly may include a stopper wedge and a mated wedge. The stopper wedge may be fixed to the door. The stopper wedge may have a primary face extending along a nonparallel angle relative to the longitudinal plane. The mated wedge may be fixed to the mullion. The mated wedge may have a receiving face complementary to the primary face of the stopper wedge to engage therewith in the first position.

In another exemplary aspect of the present disclosure, an appliance is provided. The appliance may include a cabinet, a door, a mullion, and a damping assembly. The cabinet may define a chamber. The door may be coupled to the cabinet and rotatable between an open position and a closed position to selectively seal the chamber. The door may have a perimeter edge defining a longitudinal plane. The mullion may have an inner face and an outer face. The mullion may be rotatably coupled to the door via a hinge defining an axial direction parallel to the longitudinal plane. The mullion may be rotatable about the axial direction between a first position and a second position. The damping assembly may be formed between the door and the mullion. The damping assembly may include a stopper wedge and a mated wedge. The stopper wedge may be fixed to the door. The stopper wedge may have a primary face extending along an obtuse nonparallel angle relative to the longitudinal plane. The mated wedge may be fixed to the mullion. The mated wedge may have a receiving face complementary to the primary face of the stopper wedge to engage therewith in the first position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
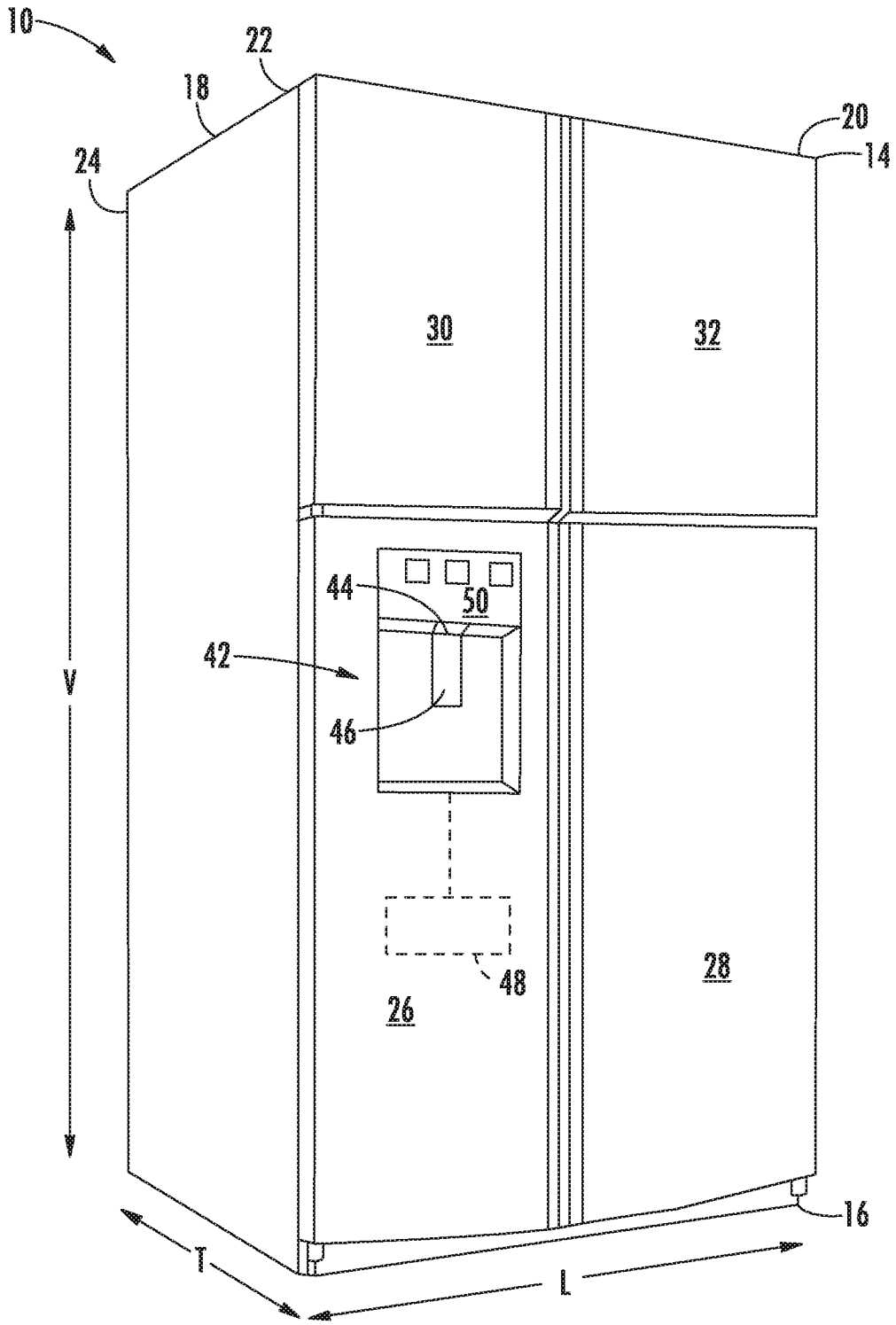
FIG. 1 provides a perspective view of a refrigerator appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The term "or" is generally intended to be inclusive (i.e., "A or B" is intended to mean "A or B or both"). Terms such as "left," "right," "front," "back," "top," or "bottom" are used with reference to the perspective of a user accessing the refrigerator appliance. For example, a user stands in front of the refrigerator to open the doors and reaches into the food storage chamber(s) to access items therein.

Figure 2:
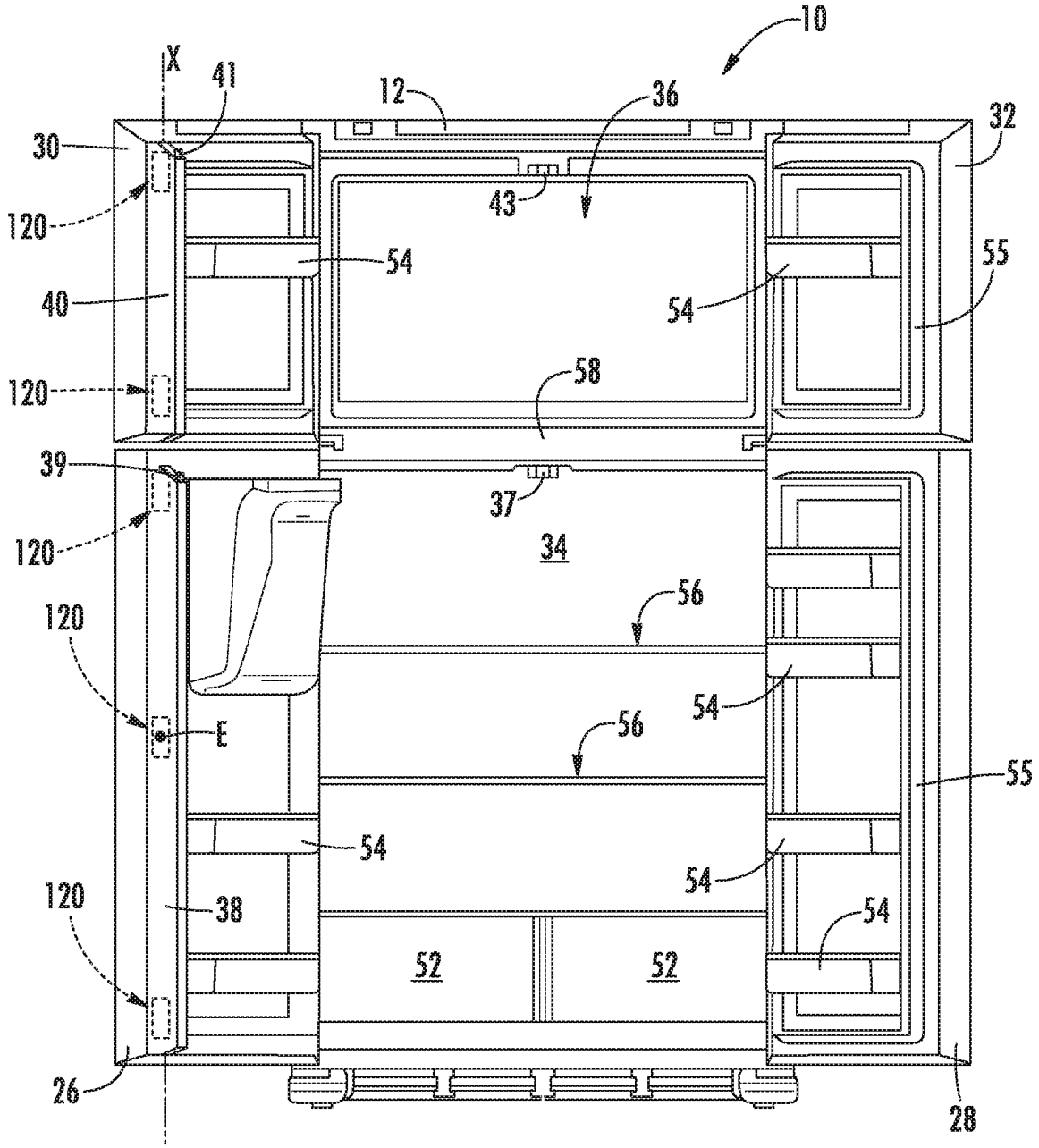
FIG. 2 provides a front elevation view of the exemplary refrigerator appliance of FIG. 1 with the doors of the exemplary refrigerator appliance shown in an open position.

FIG. 1 provides a perspective view of a refrigerator appliance 10 according to exemplary embodiments of the present disclosure. FIG. 2 provides a front view of refrigerator appliance 10 with refrigerator doors 26, 28 and freezer doors 30, 32 shown in an open position. Generally, refrigerator appliance 10 defines a vertical direction V, a lateral direction L, and a transverse direction T. The vertical direction V, the lateral direction L, and the transverse direction T are mutually perpendicular. Refrigerator appliance 10 includes a housing or cabinet 12 that extends between a top 14 and a bottom 16 along the vertical direction V, between a left side 18 and a right side 20 along the lateral direction L, and between a front side 22 and a rear side 24 along the transverse direction T.

Cabinet 12 defines at least one food storage chamber. Optionally, refrigerator appliance 10 may include a first food storage chamber (e.g., fresh food storage chamber 34) and a second food storage chamber (e.g., frozen food storage chamber 36). As depicted, the first and second food storage chambers (e.g., storage chambers 34 and 36) are chilled chambers defined in the cabinet 12 for receipt of food items for storage. In some embodiments, cabinet 12 defines fresh food storage chamber 34 positioned at or adjacent bottom 16 of cabinet 12 and frozen food storage chamber 36 arranged at or adjacent top 14 of cabinet 12. The illustrated exemplary refrigerator appliance 10 is generally referred to as a top mount refrigerator. It is recognized, however, that the benefits of the present disclosure may apply to other types and styles of refrigerators such as, for example, a bottom mount refrigerator, a side-by-side style refrigerator, or a freezer appliance. Consequently, the description set forth herein is for illustrative purposes only and is not intended to be limiting in any aspect to a particular refrigerator chamber arrangement.

In certain embodiments, refrigerator doors 26 and 28 are rotatably mounted to cabinet 12 (e.g., such that the doors permit selective access to fresh food storage chamber 34 of cabinet 12). Refrigerator doors 26 and 28 may be rotatable between a closed position (e.g., FIG. 1) and an open position (e.g., FIG. 2) to selectively seal or sealingly enclose the chamber 34. In the illustrated embodiments, refrigerator doors include a left refrigerator door 26 rotatably mounted to cabinet 12 at left side 18 of cabinet 12 and a right refrigerator door 28 rotatably mounted to cabinet 12 at right side 20 of cabinet 12. In embodiments including a pair of doors, such as left refrigerator door 26 and right refrigerator door 28 (sometimes referred to as French doors), a mullion 38 may be connected to one of the doors (e.g., left refrigerator door 26). In the illustrated example, when left refrigerator door 26 and right refrigerator door 28 are in the closed position, the mullion 38 may be provided in the corresponding second position to sealingly engage the right refrigerator door 28 and facilitate sealing of the gap G (FIG. 4) between the left refrigerator door 26 and the right refrigerator door 28.

Refrigerator doors 26 and 28 may be rotatably hinged to an edge of cabinet 12 for selectively accessing fresh food storage chamber 34. Similarly, freezer doors 30 and 32 may be rotatably hinged to an edge of cabinet 12 for selectively accessing frozen food storage chamber 36. To prevent leakage of cool air, freezer doors 30 and 32 or cabinet 12 may define one or more sealing mechanisms (e.g., rubber gaskets) at the interface where the doors 30 and 32 meet cabinet 12. Such sealing mechanisms may include a mullion 40. Mullion 40 may be similar to mullion 38 described above with respect to the refrigerator doors 26 and 28, such as in embodiments where a pair of freezer doors (e.g., a left freezer door 30 and a right freezer door 32) are provided. Refrigerator doors 26, 28 and freezer doors 30, 32 are shown in the closed position in FIG. 1 and in the open position in FIG. 2. It should be appreciated that doors having a different style, location, or configuration are possible and within the scope of the present subject disclosure.

As will be described in more detail below, the refrigerator appliance 10 may include one or more articulating mullions (e.g., mullion 38 or mullion 40), which may be rotatable relative to a corresponding door, 26, 28, 30, or 32. For example, exemplary embodiments of the refrigerator appliance 10 may include a left refrigerator door 26 and a right refrigerator door 28, as well as a left freezer door 30 and a right freezer door 32 (e.g., two pairs of French doors, which may sometimes be referred to as a quad door configuration). One or both pairs of doors 26, 28 or 30, 32 may be provided with an articulating mullion 38 or 40. For example, each articulating mullion 38, 40 may be mounted to a corresponding door (e.g., door 26, 30) at a longitudinal plane 108 defined by a perimeter edge 106 of the door 26, 30 (e.g., extending parallel to the vertical direction V).

Generally, each articulating mullion (e.g., 38, 40) extends along an axial direction X (e.g., parallel to the longitudinal plane 108 or vertical direction V) and includes a corresponding inner face 112 and outer face 114. As will also be described in more detail below, each articulating mullion (e.g., mullion 38, 40) may include one or more damping assemblies 120 formed between a corresponding door (e.g., door 26, 30) and mullion (e.g., mullion 38, 40) to, for example, advantageously maintain an articulating mullion 38, 40 in a desired position when the corresponding door 26, 30 is open.

Optionally, multiple damping assemblies 120 may be provided for each mullion-holding door (e.g., 26, 30). In some embodiments, a damping assembly 120 is provided at a center point E between a vertical top end 116 and bottom end 118 of the corresponding door (e.g., door 26, 30). This is illustrated, for example, at refrigerator door 26. In additional or alternative embodiments, one damping assembly 120 (e.g., a first damping assembly 120) is mounted proximal to the vertical top end 116 (e.g., relatively closer to the top end 116 than the bottom end 118 along the vertical direction V), and another damping assembly 120 (e.g., a second damping assembly 120) is mounted proximal to the bottom end 118 (e.g., relatively closer to the bottom end 118 than the top end 116 along the vertical direction V). This is illustrated, for example, at refrigerator door 26 and freezer door 30.

As further shown in FIG. 2, refrigerator appliance 10 includes at least one stationary mullion. Mullions generally divide the various chambers of refrigerator appliance 10 or prevent leakage therefrom. In exemplary embodiments, refrigerator appliance 10 includes a stationary mullion 58 disposed between and separating fresh food storage chamber 34 and frozen food storage chamber 36. Stationary mullion 58 generally extends along the lateral direction L between left side 18 of cabinet 12 and right side 20 of cabinet 12 and separates the chambers 34, 36 of refrigerator appliance 10 (e.g., along the vertical direction V).

In some embodiments, various storage components are mounted within fresh food storage chamber 34 and frozen food storage chamber 36 to facilitate storage of food items therein as will be understood. In particular, the storage components may include drawers 52, bins 54, and shelves 56 that are mounted within fresh food storage chamber 34 or frozen food storage chamber 36. Drawers 52, bins 54, and shelves 56 are configured for receipt of food items (e.g., beverages or solid food items) and may assist with organizing such food items. As an example, drawers 52 of fresh food storage chamber 34 can receive fresh food items (e.g., vegetables, fruits, or cheeses) and increase the useful life of such fresh food items.

As illustrated in FIG. 1, refrigerator appliance 10 may also include a dispensing assembly 42 for dispensing liquid water or ice. Dispensing assembly 42 may be positioned on or mounted to an exterior portion of refrigerator appliance 10 (e.g., on one of refrigerator doors 26 or 28). Dispensing assembly 42 includes a discharging outlet 44 for accessing ice or liquid water. An actuating mechanism 46, shown as a paddle, is mounted below discharging outlet 44 for operating dispensing assembly 42. In alternative exemplary embodiments, any suitable actuating mechanism may be used to operate dispensing assembly 42. For example, dispensing assembly 42 can include a sensor (such as an ultrasonic sensor) or a button rather than the paddle. A control panel 50 is provided for controlling the mode of operation. For example, control panel 50 generally includes a plurality of user inputs (not labeled), such as a water dispensing button and an ice-dispensing button, for selecting a desired mode of operation, such as crushed or non-crushed ice.

In some embodiments, refrigerator appliance 10 further includes a controller 48. Operation of the refrigerator appliance 10 may be regulated by controller 48, which is operatively coupled to control panel 50 (e.g., via one or more signal lines or shared communication busses). In certain exemplary embodiments, control panel 50 represents a general purpose I/O ("GPIO") device or functional block. In exemplary embodiments, control panel 50 includes input components, such as one or more of a variety of electrical, mechanical or electro-mechanical input devices including rotary dials, push buttons, touch pads, and touch screens. Control panel 50 provides selections for user manipulation of the operation of refrigerator appliance 10. In response to user manipulation of the control panel 50, controller 48 operates various components of refrigerator appliance 10. For example, controller 48 is operatively coupled or in communication with various components of a sealed refrigeration system (e.g., to set or adjust temperatures within the cabinet 12, such as within the fresh food storage chamber 34). Controller 48 may also be communicatively coupled with a variety of sensors, such as, chamber temperature sensors or ambient temperature sensors. Controller 48 may receive signals from these temperature sensors that correspond to the temperature of an atmosphere or air within their respective locations.

Controller 48 includes memory and one or more processing devices such as microprocessors, CPUs or the like, such as general or special purpose microprocessors operable to execute programming instructions or micro-control code associated with operation of refrigerator appliance 10. The memory can represent random access memory such as DRAM, or read only memory such as ROM or FLASH. The processor executes programming instructions stored in the memory. The memory can be a separate component from the processor or can be included onboard within the processor. Alternatively, controller 48 may be constructed without using a microprocessor (e.g., using a combination of discrete analog or digital logic circuitry—such as switches, amplifiers, integrators, comparators, flip-flops, AND gates, and the like—to perform control functionality instead of relying upon software).

Figure 3:
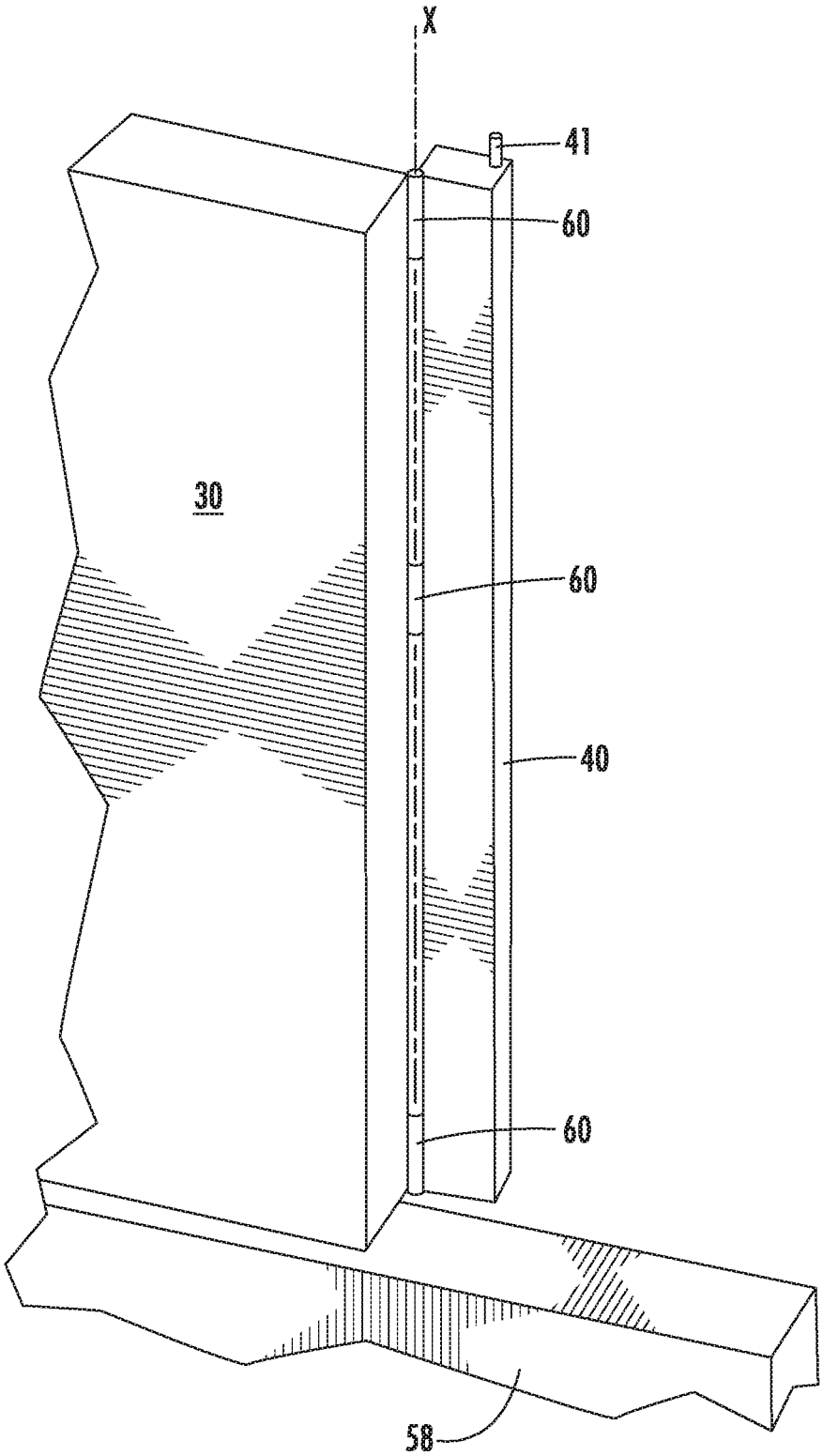
FIG. 3 provides a perspective view of a door, a stationary mullion, and an articulating mullion connected to the door of the refrigerator appliance of FIG. 1.

FIG. 3 provides a perspective view of door 30, stationary mullion 58, and articulating mullion 40 connected to door 30. As shown in FIG. 3, articulating mullion 40 can be rotatably coupled or rotatably hinged, via hinges 60, to door 30. Articulating mullion 40 can be rotated or articulated about the axial direction X (e.g., parallel to the vertical direction V) through hinges 60 as shown. Articulating mullion 40 may be rotatable about hinges 60 between a first position (e.g., corresponding to the open position of the door 30) and a second position (e.g., corresponding to a closed position of the door 30). Articulating mullion 40 can include additional hinges 60 or hinge components thereof in some exemplary embodiments. Moreover, articulating mullion 38 may, in various embodiments, include hinges similar to those shown and described with respect to mullion 40.

Further, it should be understood that examples illustrated and described herein with respect to either one of mullion 38 or mullion 40 are equally applicable to the other of mullion 38 or mullion 40. Thus, in various embodiments, refrigerator appliance 10 may include one or both sets of French doors 26, 28 or 30, 32, with one or both of mullion 38 or mullion 40 associated with a respective one of the doors 26, 28, 30, or 32, and either mullion 38 or mullion 40 may include various combinations of any or all of the features shown and described herein with respect to either mullion 38 or mullion 40.

In the exemplary embodiments, such as those shown in FIG. 3, articulating mullion 40 includes a tab 41 extending from the mullion 40. In some such embodiments, tab 41 extends from a top portion of the mullion 40. In additional or alternative embodiments, a tab 41 extends from a bottom portion of the mullion 40. In some such embodiments, mullion 40 includes tabs 41 extending from both a top portion and a bottom portion.

Figure 7:
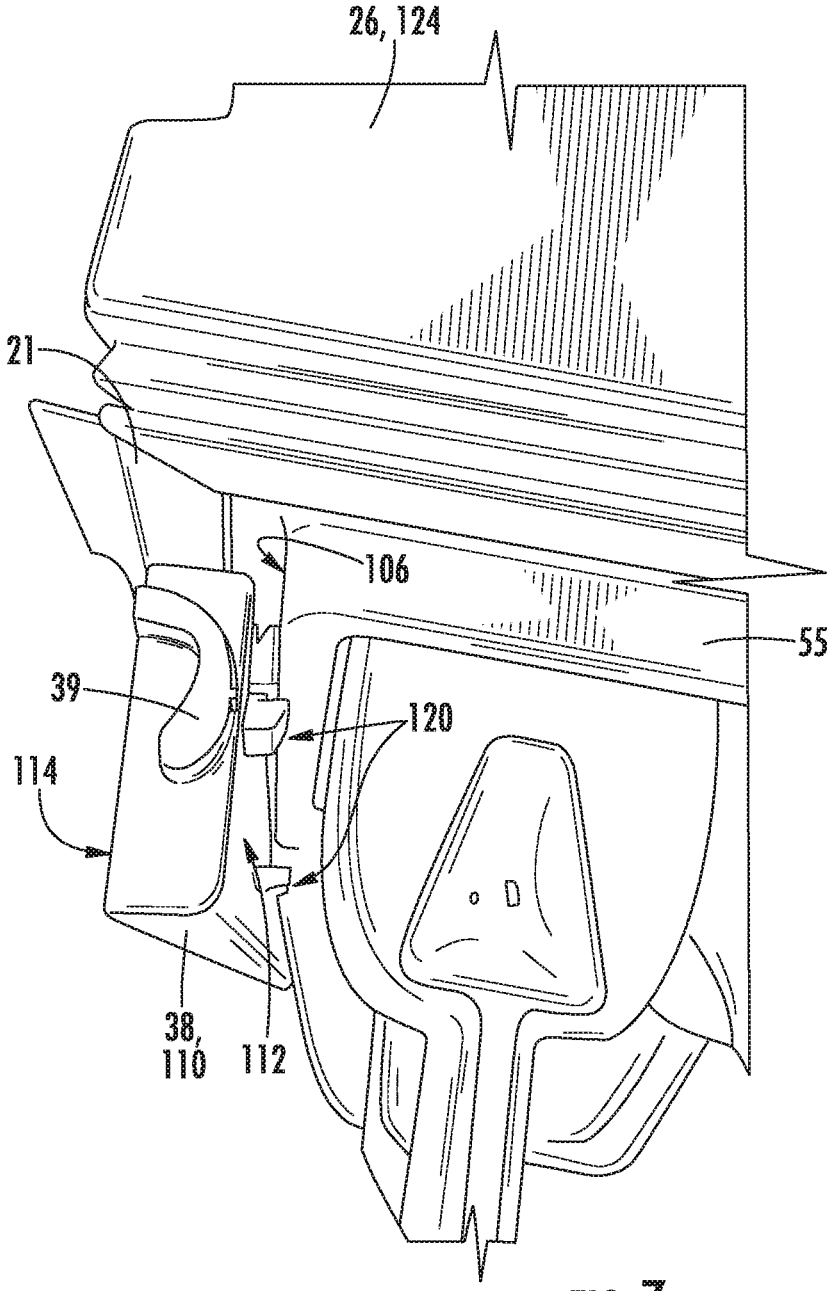
FIG. 7 provides an overhead perspective view of a door of an exemplary refrigerator appliance with a mullion in a first position.
Figure 8:
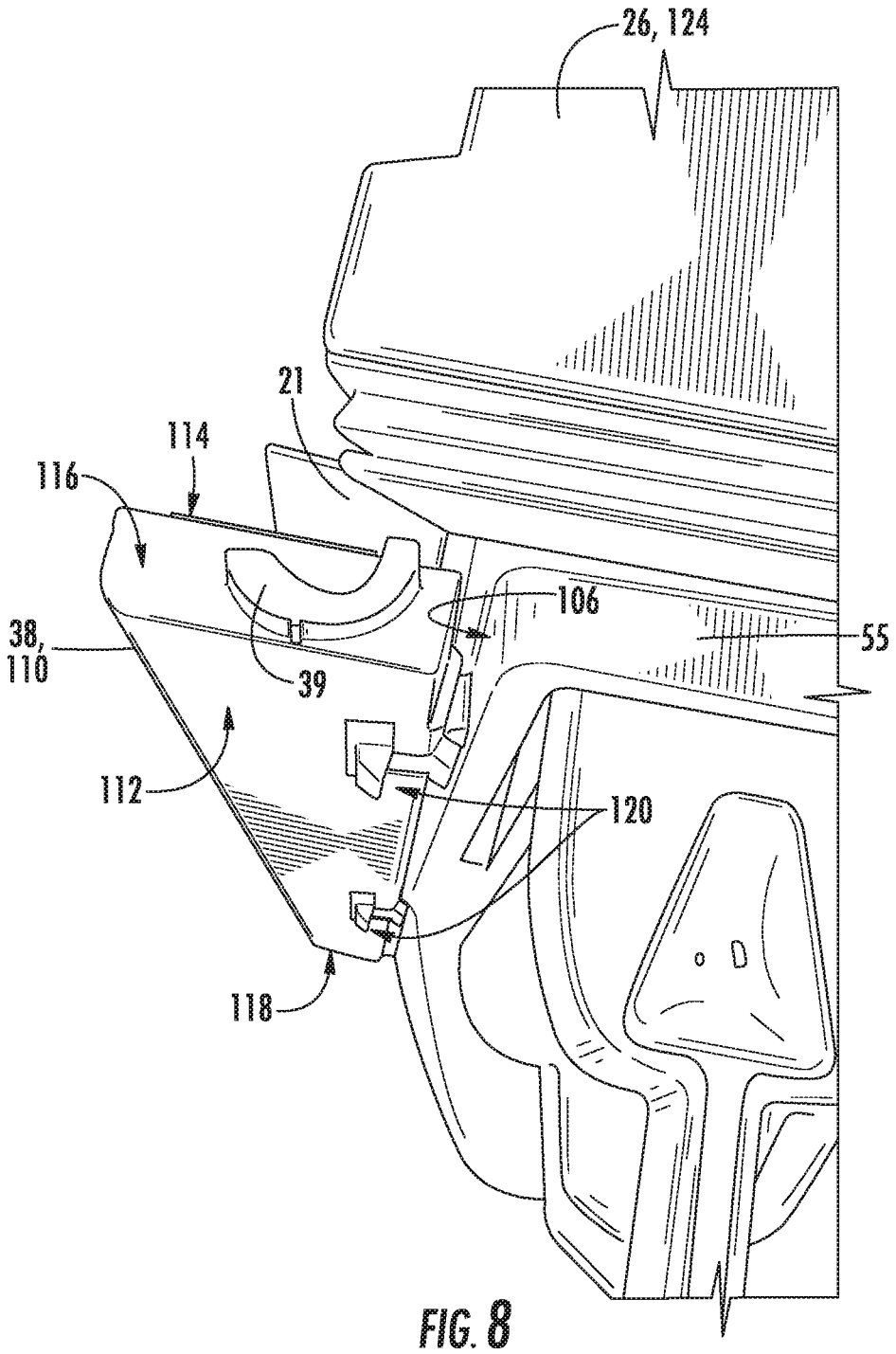
FIG. 8 provides an overhead perspective view of a door of an exemplary refrigerator appliance with a mullion in a second position.
Figure 9:
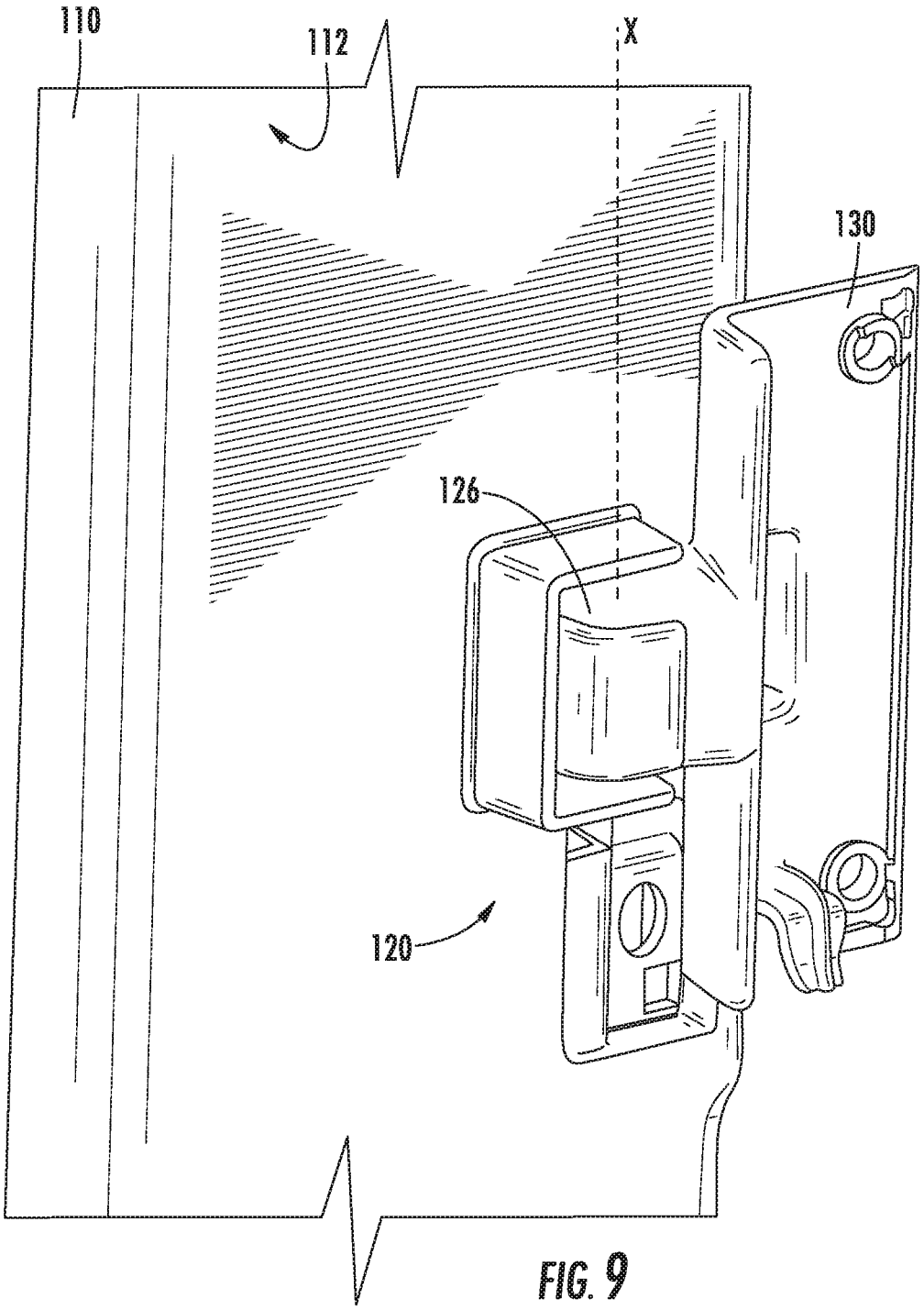
FIG. 9 provides a perspective view of an articulating mullion and damper assembly in a first position according to exemplary embodiments of the present disclosure.
Figure 10:
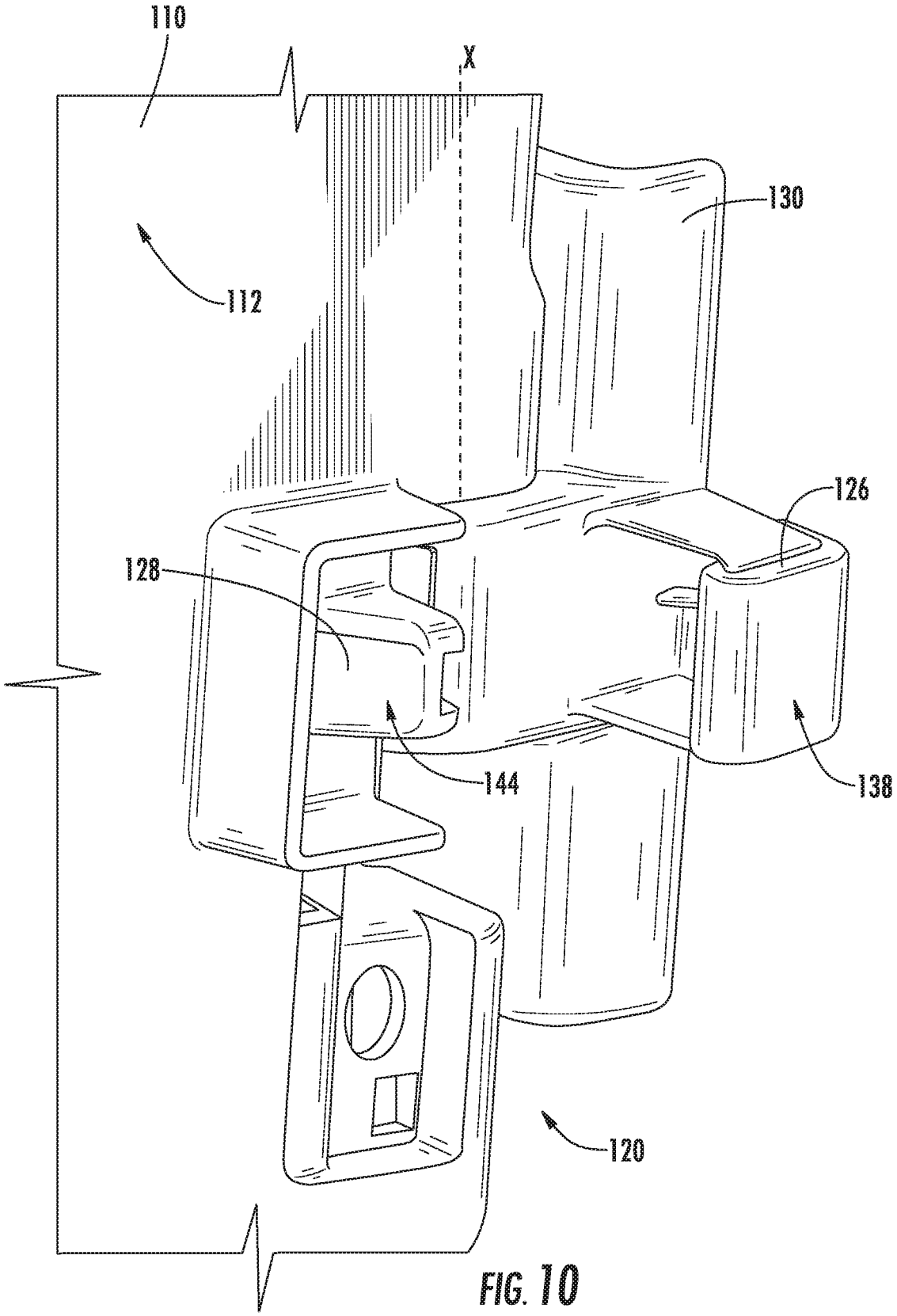
FIG. 10 provides a perspective view of an articulating mullion and damper assembly in a second position according to exemplary embodiments of the present disclosure.
Figure 11:
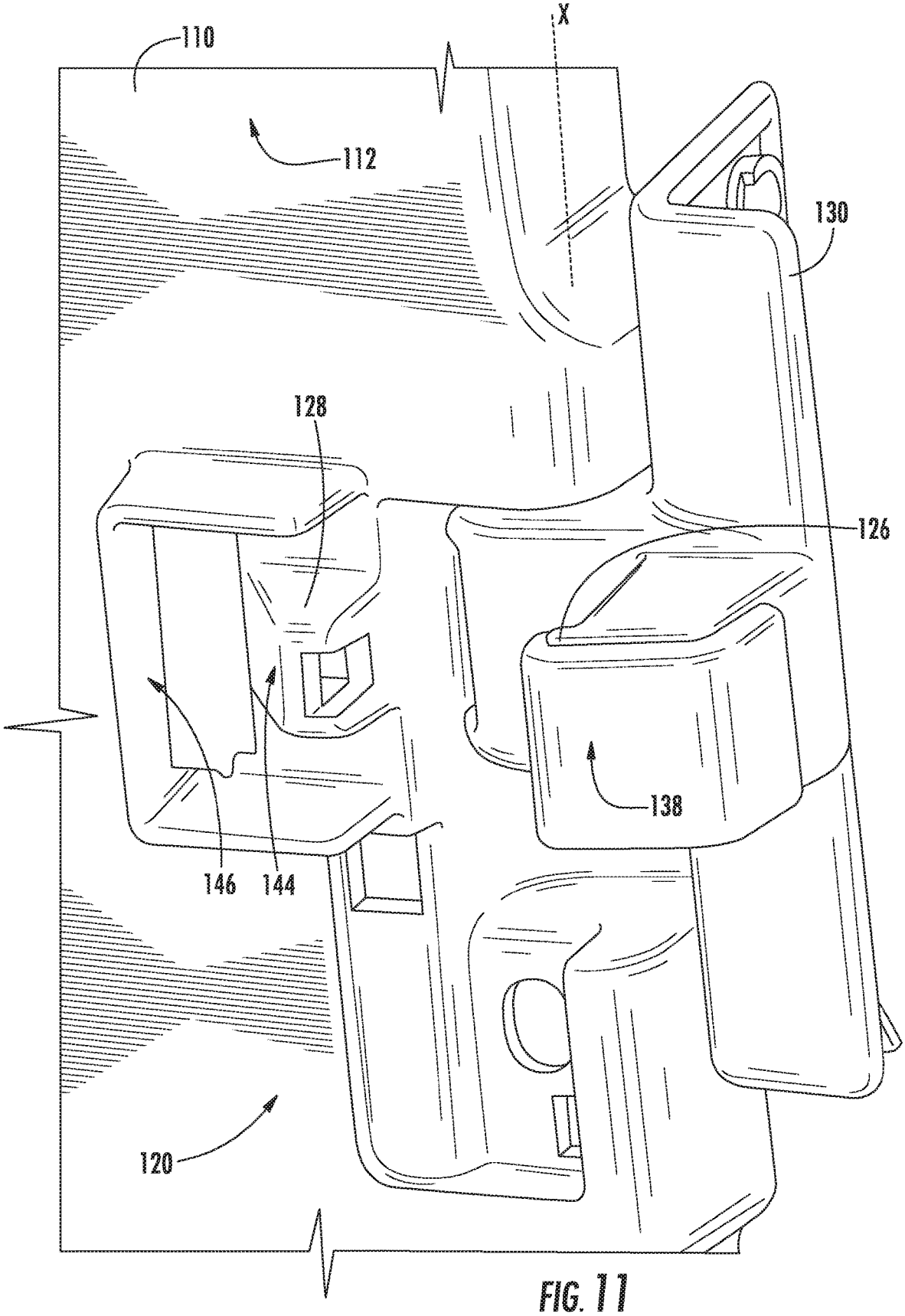
FIG. 11 provides a perspective view of an articulating mullion and damper assembly in a second position according to exemplary embodiments of the present disclosure.

Generally, tab 41 is sized and shaped to fit within and interact with a groove 43 defined in cabinet 12 of refrigerator appliance 10 (FIG. 2). For example, groove 43 may include cam surfaces that may interact with tab 41 to cause rotation of articulating mullion 40 when door 26 is rotated from a closed to open position or vice versa. As generally shown in FIG. 2, mullion 38 may also include a tab 39 which interacts with a groove 37, and may include similar details a described above and shown in FIG. 3 with respect to the structure and function of the tab 41 and groove 43 of mullion 40. Additionally, in other embodiments, the tab (e.g., tab 41 or 39) is provided on the cabinet 12 while the groove (e.g., groove 37 or 43) is provided on a corresponding mullion (e.g., mullion 38 or 40). Moreover, although FIGS. 2 and 3 generally illustrate the tabs 41, 39 as vertical posts, any suitable shape may be provided. For instance, either or both tabs 41, 39 may be provided as an arcuate or curved member (e.g., as illustrated in FIGS. 7 and 8) to slide within the corresponding groove (e.g., groove 37 or 43).

Figure 4:
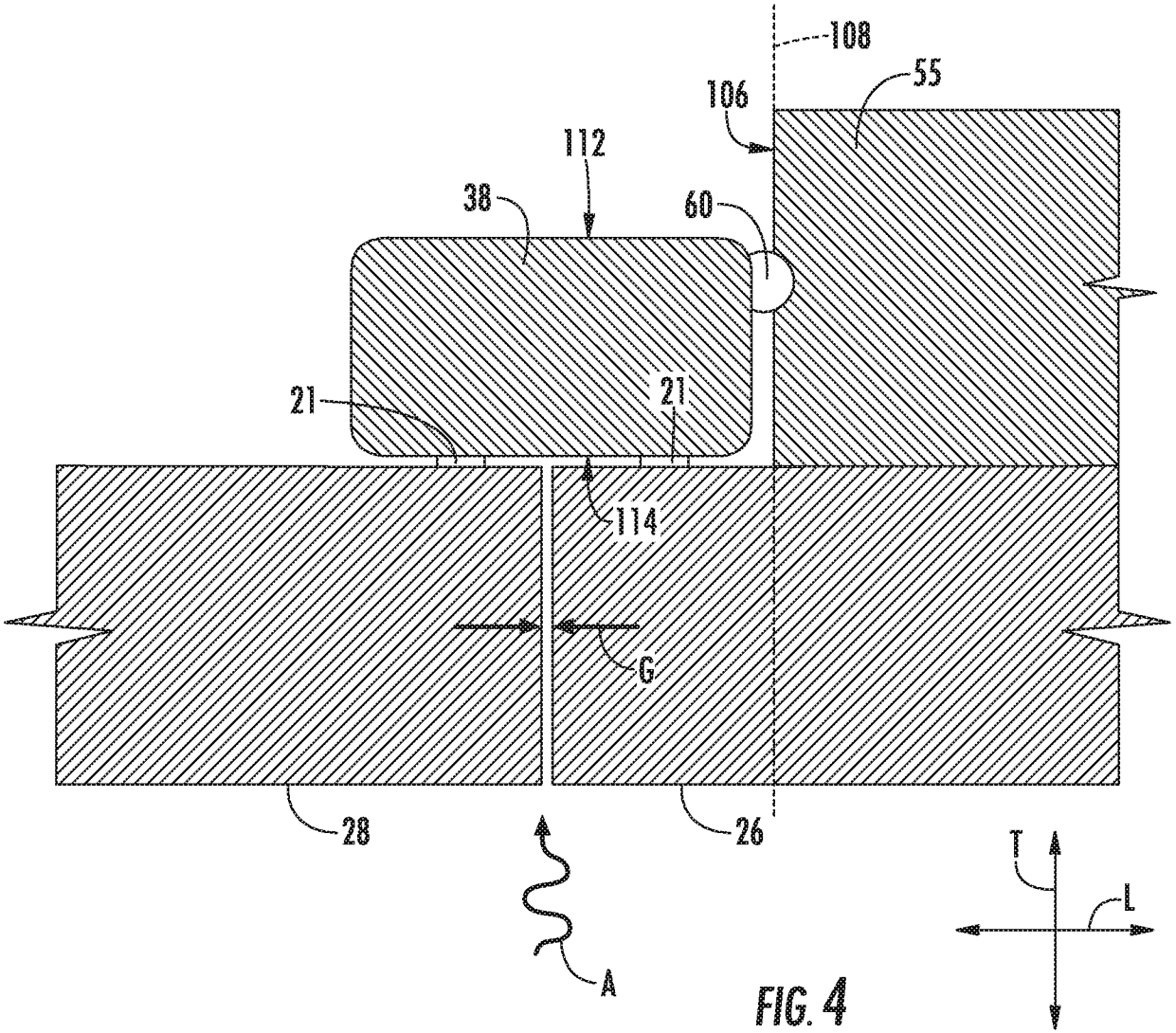
FIG. 4 provides a sectional view of doors of an exemplary refrigerator appliance in a closed position and contacting an exemplary articulating mullion according to an exemplary embodiment of the present disclosure.

FIG. 4 provides a close-up, sectional view of doors 26, 28 of refrigerator appliance 10 in a closed position and contacting articulating mullion 38. In some such embodiments, articulating mullion 38 is rotatably coupled or hinged to door 28 via hinge 60. In the illustrated example, the storage bins 54 (FIG. 2) are secured to and supported on each respective door 26, 28, 30, and 32 via a structural wall 55 defining a perimeter edge 106 of each respective door 26, 28, 30, and 32. Further, as shown in FIG. 4, articulating mullion 38 is connected to structural wall 55 defined on an inner surface of door 28. As noted above, various combinations of the foregoing features are possible. For instance, the articulating mullion 38 may be connected to a structural wall of door 26 or articulating mullion 40 may be connected to a structural wall on door 30 or door 32. Moreover, in some embodiments the hinge 60 may be coupled to the inner surface of the corresponding door (e.g., proximate to one of the gaskets 21).

As shown in FIG. 4, when doors 26, 28 are in a closed position, articulating mullion 38 is generally provided in a second position, extending between doors 26, 28 along the lateral direction L and behind doors 26, 28 along the transverse direction T. Accordingly, articulating mullion 38 may prevent leakage between doors 26, 28. More specifically, when doors 26, 28 are in a closed position, a gap G is defined between doors 26, 28. Ambient air A, which is generally warm relative to the cooled or chilled air of chambers 34 and 36 of refrigerator appliance 10, flows through gap G and contacts articulating mullion 38. As articulating mullion 38 is positioned to block the airflow through gap G, articulating mullion 38 prevents relatively warm ambient air A from leaking into refrigerator appliance 10. Articulating mullion 38 also prevents cooled or chilled air from flowing out of refrigerator appliance 10. To prevent such leakage, inner surfaces of each door 26, 28, or gaskets 21 along such inner surfaces, contact the articulating mullion 38 and are in sealing engagement with articulating mullion 38.

Articulating mullion 38 or 40 defines a cross-sectional shape. In the exemplary embodiments, such as those illustrated in FIG. 4, mullion 38 defines a generally rectangular cross-sectional shape. However, it is understood that mullions 38 or 40 can have any suitable cross-sectional shape, such as a circular, oval, or polygonal cross-sectional shape.

Figure 5:
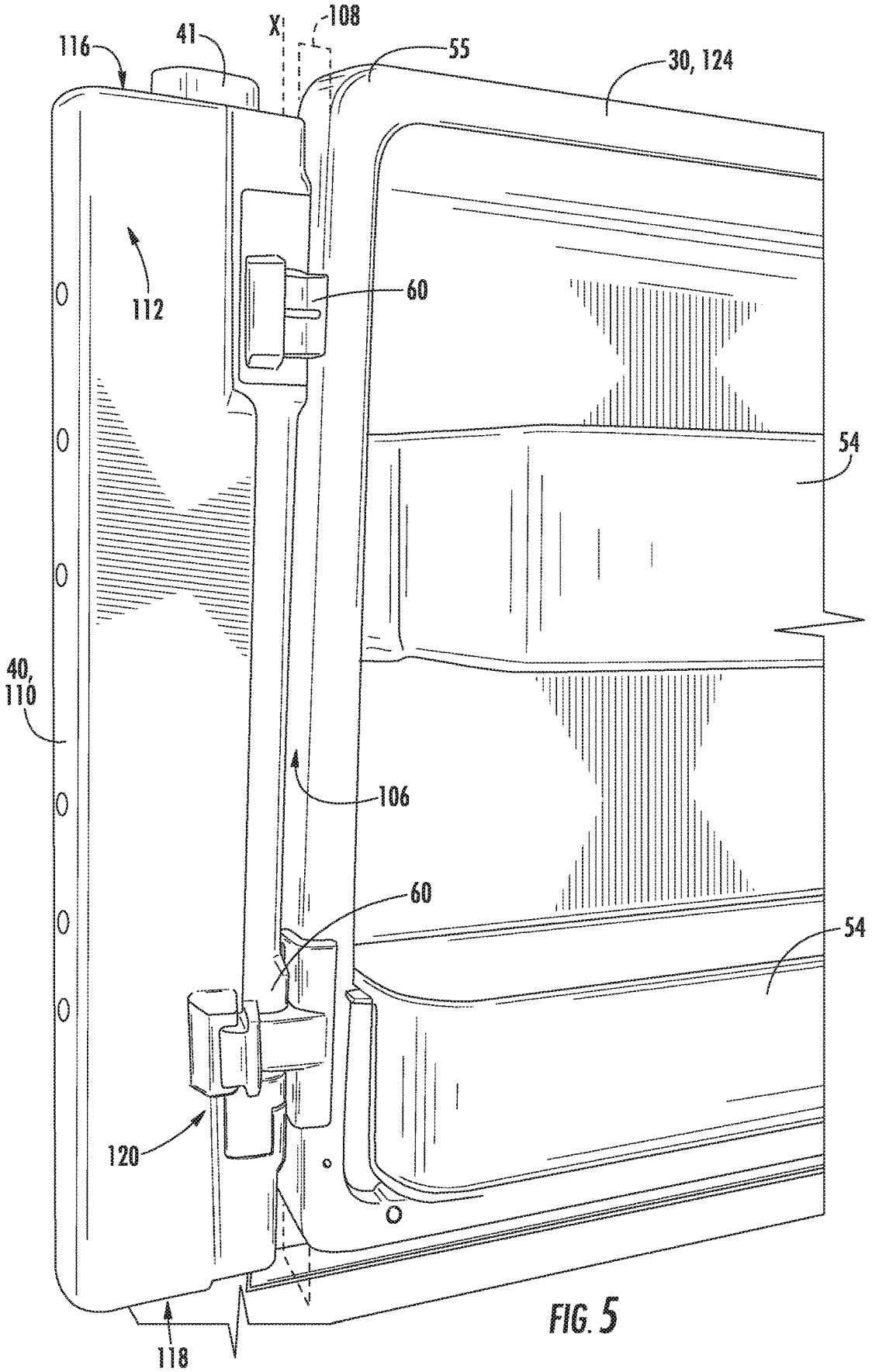
FIG. 5 provides a rear perspective view of a door of an exemplary refrigerator appliance in an open position.
Figure 6:
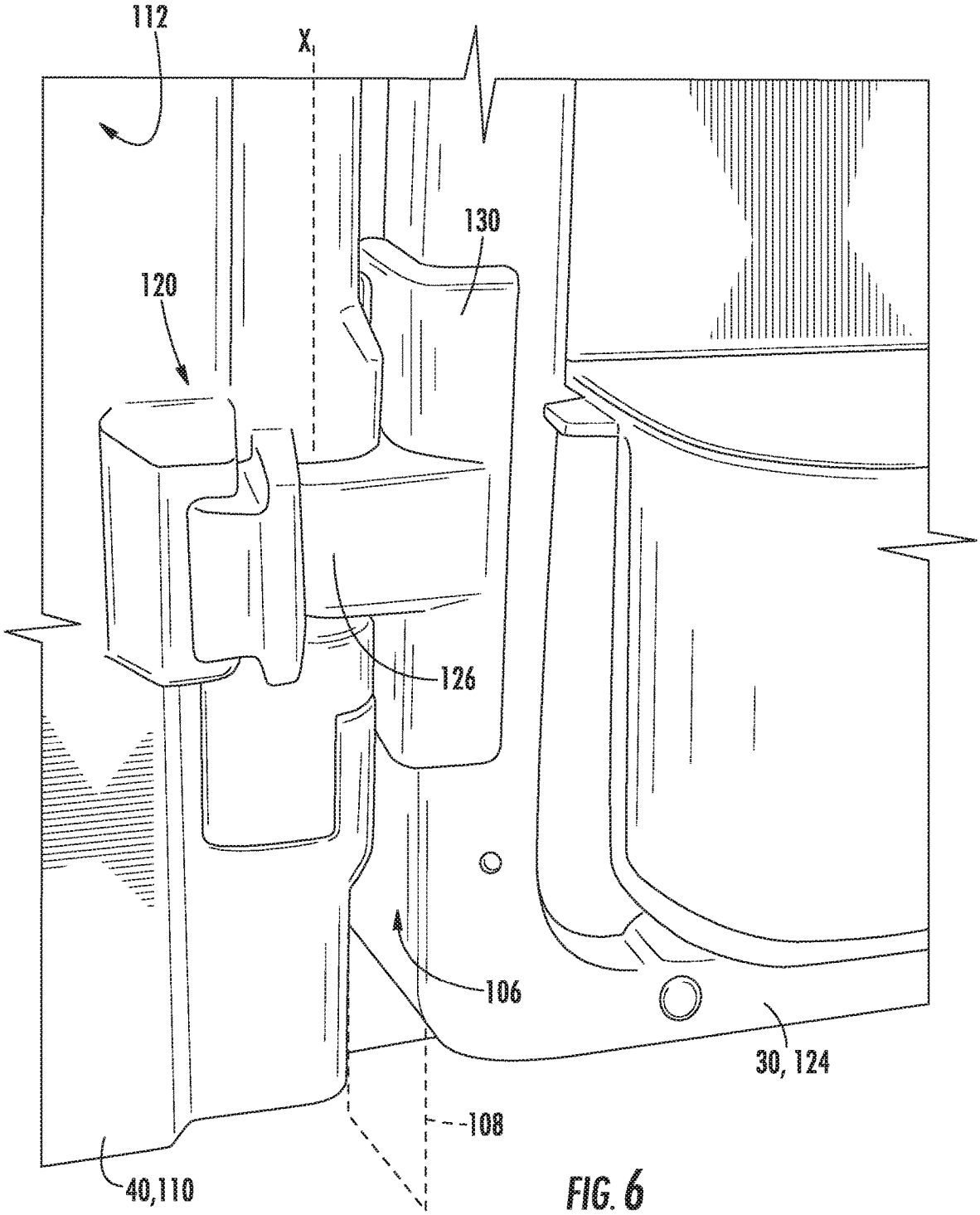
FIG. 6 provides a magnified view of a portion of the door of the exemplary embodiment of FIG. 5.

Turning now to FIGS. 5 through 12, FIGS. 5 through 8 provide various view of an articulating or movable mullion 110 mounted to an appliance door 124. Specifically, FIGS. 5 and 6 illustrate a mullion 110 rotatably mounted to an appliance door 124 (e.g., door 30). FIGS. 7 and 8 illustrate a mullion 110 rotatably mounted to an appliance door 124 (e.g., door 26). FIGS. 9 through 12 provide various views of a movable mullion 110 and damping assembly 120 in isolation (i.e., with appliance door 124 removed for better illustrating the structure of movable mullion 110). As would be understood, the mullion 110 of FIGS. 5 through 12, may be provided as or include one or more of the features of articulating mullions 38, 40, described above with respect to FIGS. 1 through 4. Similarly, appliance door 124 may be provided as a refrigerator door 26 or freezer door 30, described above with respect to FIGS. 1 through 4.

As noted above, an articulating mullion 110 may be rotatable about the axial direction X between a first position and a second position. The first position generally provides the articulating mullion 110 in an inward-folded arrangement such that the inner face 112 is adjacent to the longitudinal plane 108 of the appliance door 124 (e.g., as illustrated in FIG. 7). By contrast, the second position provides the articulating mullion 110 in an outward-facing arrangement such that the outer face 114 may engage the gaskets 21 of one or more appliance door 124 (e.g., as illustrated in FIG. 8).

In some embodiments, one or more damping assemblies 120 may be provided or formed between the appliance door 124 and the articulating mullion 110. Generally, a damping assembly 120 may include a stopper wedge 126 and a mated wedge 128 positioned at the same axial (e.g., vertical) height to selectively engage each other (e.g., when the articulating mullion 110 is in the first position). As illustrated, the stopper wedge 126 and mated wedge 128 may be located between the longitudinal plane 108 of the appliance door 124 and the inner face 112 of the articulating mullion 110. Thus, the stopper wedge 126 and the mated wedge 128 may be generally positioned rearward from the hinge 60 or gasket 21 (e.g., FIG. 4) (e.g., such that damping assembly 120 is closer to the corresponding chamber 34 or 36 along the transverse direction T when the appliance door 124 is in the closed position).

When assembled, the stopper wedge 126 is fixed to a corresponding appliance door 124. In turn, stopper wedge 126 may generally rotate or move in tandem with the appliance door 124 (e.g., as the door 124 opens/closes), while remaining stationary relative to the appliance door 124 itself. As shown, the stopper wedge 126 may be mounted (e.g., by one or more adhesives or mechanical fasteners, such as a screw, bolt, clips, etc.) on a perimeter edge 106 or inner surface of the corresponding appliance door 124. In some such embodiments, a wedge bracket 130 supports the stopper wedge 126 on the appliance door 124. External forces acting on the stopper wedge 126 may be transmitted to the appliance door 124 through the wedge bracket 130. Optionally, the wedge bracket 130 may be formed as an integral or unitary member with the stopper wedge 126 (or portion thereof). In additional or alternative embodiments, the stopper wedge 126 or wedge bracket 130 is formed as an integral or unitary member with at least a portion of the appliance door 124 (e.g., at perimeter edge 106).

In contrast to the stopper wedge 126, the mated wedge 128 may be fixed to the articulating mullion 110. In turn, the mated wage may generally rotate or move with the articulating mullion 110 relative to the appliance door 124. Thus, as the articulating mullion 110 pivots about the axial direction X between the first position and the second position, the mated wedge 128 may do the same. Moreover, together, mated wedge 128 and articulating mullion 110 may be spaced apart from the stopper wedge 126 in the second position. As shown, mated wedge 128 may be formed on or with the inner face 112 of the articulating mullion 110. Alternatively, mated wedge 128 may be formed as a discrete element that is mounted to the articulating mullion 110 (e.g., by one or more adhesives or mechanical fasteners, such as a screw, bolt, clips, etc.).

Turning especially to FIGS. 9 through 12, the stopper wedge 126 generally extends toward the first position location of the mated wedge 128 and inner face 112 of the articulating mullion 110. Specifically, the stopper wedge 126 includes a primary face 132 that extends along and defines a nonparallel angle θ1 (e.g., first nonparallel angle) relative to the longitudinal plane 108. Generally, the nonparallel angle θ1 of the primary face 132 may be defined from a base engagement point 134 to a peak engagement point 136. Optionally, the nonparallel angle θ1 of the primary face 132 may be an obtuse angle (e.g., between 90° and 140°).

As is understood, the primary face 132 may be formed as a substantially flat surface that directly follows the nonparallel angle θ1 from the base engagement point 134 to the peak engagement point 136. Alternatively, and as illustrated in FIGS. 9 through 12, primary face 132 may be formed as a curved (e.g., concave) surface between the base engagement point 134 to the peak engagement point 136. In such embodiments, the nonparallel angle θ1 may be defined as an average of the curved surface angles between the base engagement point 134 and the peak engagement point 136.

Along with the primary face 132 stopper wedge 126 may include a secondary face 138 that is defined opposite the primary face 132 (e.g., relative to the peak engagement point 136). For example, secondary face 138 may extend along and define a nonparallel angle θ2 (e.g., second nonparallel angle) relative to the longitudinal plane 108. In some embodiments, the primary face 132 is positioned proximal to the axial direction X, while the secondary face 138 is positioned distal to the axial direction X (e.g., along the radial direction R). Generally, the nonparallel angle θ2 of the secondary face 138 is different from (e.g., non-equal to) the nonparallel angle θ1 of the primary face 132 and may be defined from a secondary base point 140 to a secondary peak point 142. In some such embodiments, an intermediate surface of the stopper wedge 126 extends between the peak engagement point 136 and the secondary peak point 142 (e.g., parallel to the longitudinal plane 108). Optionally, the nonparallel angle θ2 of the secondary face 138 may be a perpendicular or acute angle (e.g., between 60° and 90°).

As illustrated, the secondary face 138 may be formed as a substantially flat surface that directly follows the nonparallel angle θ2 from the secondary base point 140 to the secondary peak point 142. Alternatively, the secondary face 138 may be formed as a curved (e.g., convex) surface where, for example, the nonparallel angle θ2 is defined as an average of the curved surface angles between the secondary base point 140 and the secondary peak point 142.

As shown, the mated wedge 128 includes defines a receiving face 144 that is complementary the primary face 132. In other words, the receiving face 144 of the mated wedge 128 may be shaped to engage or receive primary face 132 (e.g., in the first position). Accordingly, receiving face 144 may be defined as a substantially flat or, alternatively, curved (e.g., convex) surface that is matched to the primary face 132. In some embodiments, the receiving face 144 contacts (e.g., directly or indirectly) the primary face 132 when the articulating mullion 110 is in the first position. However, as the articulating mullion 110 is moved to the second position, contact between the receiving face 144 and primary face 132 may be broken. Notably, engagement between primary face 132 and receiving face 144 (e.g., as the articulating mullion 110 is rotated during opening of the corresponding door 124—FIG. 7) may disperse the reactionary forces between stopper wedge 126 and mated wedge 128. Advantageously, a deflection or return bounce by the articulating mullion 110 may be prevented and articulating mullion 110 may be maintained in the first position (e.g., until the corresponding door 124 is closed).

In embodiments wherein a secondary face 138 is provided at the stopper wedge 126, mated wedge 128 may include or define a holding face 146 that is complementary to the secondary face 138. As illustrated, the holding face 146 of the mated wedge 128 may be shaped to engage or receive the secondary face 138 (e.g., in the first position). Accordingly, holding face 146 may be defined as a substantially flat or, alternatively, curved (e.g., concave) surface that is matched to the secondary face 138. In some embodiments, the holding face 146 contacts (e.g., directly or indirectly) the secondary face 138 when the articulating mullion 110 is in the first position. However, as the articulating mullion 110 is moved the second position, contact between the holding face 146 and the secondary face 138 may be broken.

Figure 12:
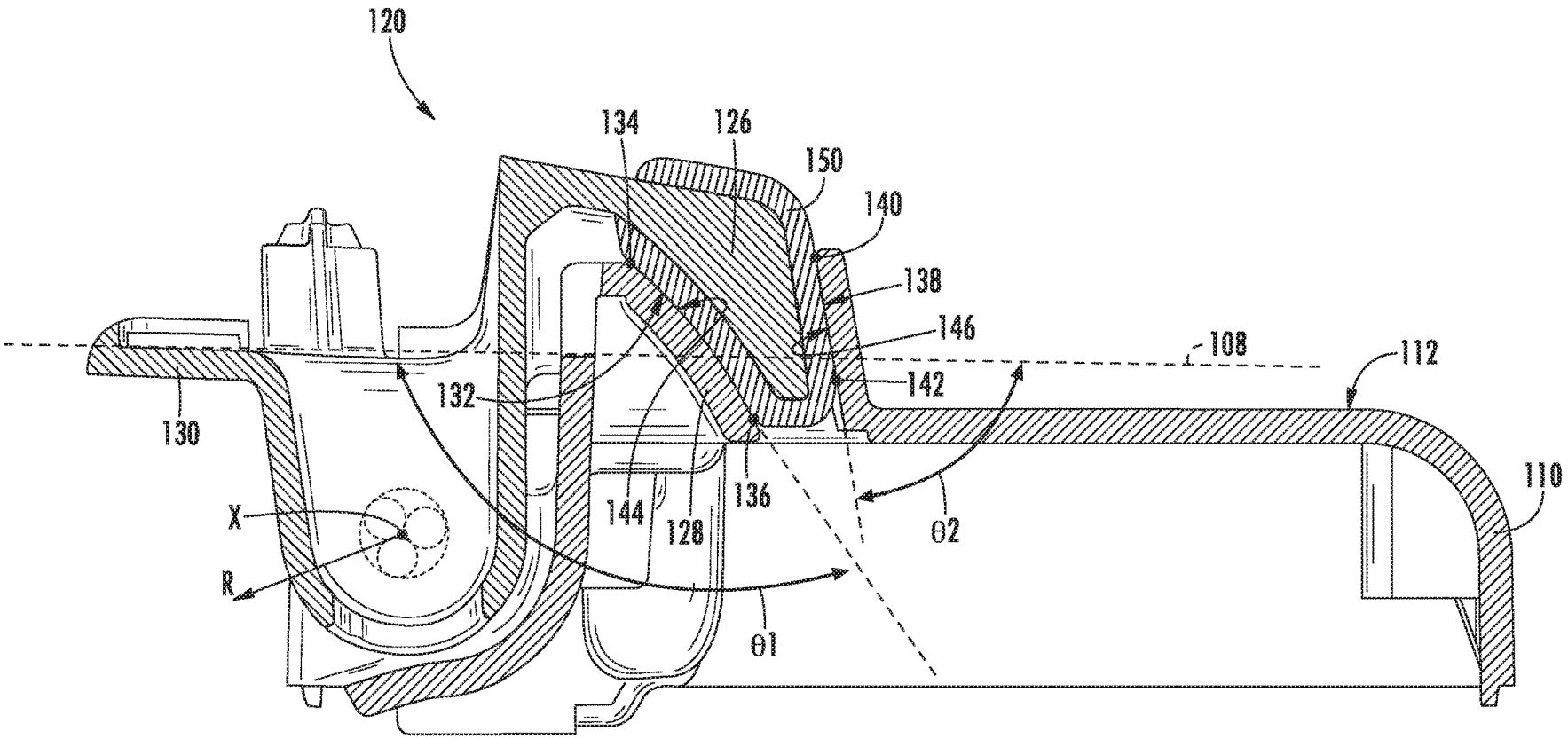
FIG. 12 provides a sectional view of a portion of an articulating mullion and damper assembly in a first position according to exemplary embodiments of the present disclosure.

One or both of stopper wedge 126 or mated wedge 128 may be formed from a substantially solid, non-elastic material (e.g., rigid metal or polymer). In optional embodiments, an elastic damping material 150 (e.g., foam, rubber, non-rigid polymer, or any suitable resilient damping material) is provided between the stopper wedge 126 in the mated wedge 128 to cushion or absorb at least a portion of the force is transmitted between the stopper wedge 126 and the mated wedge 128. For example, as illustrated in FIG. 12, a layer of elastic damping material 150 may be fixed on the stopper wedge 126 (e.g., by a suitable adhesive or mechanical fastener). The elastic damping material 150 may thus generally follow or define primary face 132 or the secondary face 138. Additionally or alternatively, a layer of elastic damping material 150 may be fixed on or within the mated wedge 128. The elastic damping material 150 may thus generally follow or define the receiving face 144 or the holding face 146.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance defining a vertical direction and a transverse direction, the appliance comprising:

a cabinet defining a chamber;

a door coupled to the cabinet and rotatable between an open position and a closed position to selectively seal the chamber, the door having a perimeter edge defining a longitudinal plane;

a mullion having an inner face and an outer face, the mullion being rotatably coupled to the door via a hinge defining an axial direction parallel to the longitudinal plane, the mullion being rotatable about the axial direction between a first position and a second position; and a damping assembly formed between the door and the mullion, the damping assembly comprising a stopper wedge fixed to the door, the stopper wedge having a primary face extending vertically and along a nonparallel angle relative to the longitudinal plane, and a mated wedge fixed to the mullion, the mated wedge having a receiving face extending vertically and complementary to the primary face of the stopper wedge to engage therewith in the first position, wherein the nonparallel angle is obtuse relative to the longitudinal plane, wherein the closed position provides the mated wedge offset from the hinge along the transverse direction, and wherein an open space is defined along a semi-circumferential path about the axial direction between the receiving face and the primary face in the second position, the open space being traversed by the mated wedge as the receiving face is moved to engagement with the primary face of the stopper wedge in the first position.

2. The appliance of claim 1, wherein the first position of the mullion corresponds to the open position of the door and the second position of the mullion corresponds to the closed position of the door.

3. The appliance of claim 1, wherein the stopper wedge further has a secondary face opposite the primary face, and wherein the mated wedge further has a holding face complementary to the secondary face of the stopper wedge to engage therewith in the first position.

4. The appliance of claim 3, wherein the nonparallel angle is a first nonparallel angle, wherein the secondary face extends along a second nonparallel angle relative to the longitudinal plane, and wherein the second nonparallel angle is different from the first nonparallel angle.

5. The appliance of claim 1, wherein the damping assembly further comprises an elastic damping material positioned between the stopper wedge and the mated wedge.

6. The appliance of claim 1, wherein the mullion is spaced apart from the stopper wedge in the second position.

7. The appliance of claim 1, wherein the door extends along the vertical direction between a top end and a bottom end, and wherein the damping assembly is mounted at a center point between the top end and the bottom end.

8. The appliance of claim 1, wherein the damping assembly is a first damping assembly, and wherein the appliance further comprises a second damping assembly axially spaced apart from the first damping assembly, the second damping assembly comprising a stopper wedge fixed to the door, the stopper wedge having a primary face extending along a nonparallel angle relative to the longitudinal plane, and a mated wedge fixed to the mullion, the mated wedge having a receiving face complementary to the primary face of the stopper wedge to engage therewith in the first position.

9. The appliance of claim 8, wherein the door extends along the vertical direction between a top end and a bottom end, wherein the first damping assembly is mounted proximal to the top end, and wherein the second damping assembly is mounted proximal to the bottom end.

10. An appliance defining a vertical direction and a transverse direction, the appliance comprising:

a cabinet defining a chamber;

a door coupled to the cabinet and rotatable between an open position and a closed position to selectively seal the chamber, the door having a perimeter edge defining a longitudinal plane;

a mullion having an inner face and an outer face, the mullion being rotatably coupled to the door via a hinge defining an axial direction parallel to the vertical direction and the longitudinal plane, the mullion being rotatable about the axial direction between a first position corresponding to the open position of the door and a second position corresponding to the closed position of the door; and a damping assembly formed between the door and the mullion, the damping assembly comprising a stopper wedge fixed to the door, the stopper wedge having a primary face extending vertically and along a nonparallel angle relative to the longitudinal plane, and a mated wedge fixed to the mullion, the mated wedge having a receiving face extending vertically and complementary to the primary face of the stopper wedge to engage therewith in the first position, wherein the closed position provides the mated wedge offset from the axial direction along the transverse direction, and wherein an open space is defined along a semi-circumferential path about the axial direction between the receiving face and the primary face in the second position, the open space being traversed by the mated wedge as the receiving face is moved to engagement with the primary face of the stopper wedge in the first position.

11. The appliance of claim 10, wherein the stopper wedge further has a secondary face opposite the primary face, and wherein the mated wedge further has a holding face complementary to the secondary face of the stopper wedge to engage therewith in the first position.

12. The appliance of claim 11, wherein the nonparallel angle is a first nonparallel angle, wherein the secondary face extends along a second nonparallel angle relative to the longitudinal plane, and wherein the second nonparallel angle is different from the first nonparallel angle.

13. The appliance of claim 10, wherein the damping assembly further comprises an elastic damping material positioned between the stopper wedge and the mated wedge.

14. The appliance of claim 10, wherein the mullion is spaced apart from the stopper wedge in the second position.

15. The appliance of claim 10, wherein the door extends along the vertical direction between a top end and a bottom end, and wherein the damping assembly is mounted at a center point between the top end and the bottom end.

16. The appliance of claim 10, wherein the damping assembly is a first damping assembly, and wherein the appliance further comprises a second damping assembly axially spaced apart from the first damping assembly, the second damping assembly comprising a stopper wedge fixed to the door, the stopper wedge having a primary face extending along a nonparallel angle relative to the longitudinal plane, and a mated wedge fixed to the mullion, the mated wedge having a receiving face complementary to the primary face of the stopper wedge to engage therewith in the first position.

17. The appliance of claim 16, wherein the door extends along the vertical direction between a top end and a bottom end, wherein the first damping assembly is mounted proximal to the top end, and wherein the second damping assembly is mounted proximal to the bottom end.

18. An appliance defining a vertical direction and a transverse direction, the appliance comprising:

a cabinet defining a chamber;

a door coupled to the cabinet and rotatable between an open position and a closed position to selectively seal the chamber, the door having a perimeter edge defining a longitudinal plane;

a mullion having an inner face and an outer face, the mullion being rotatably coupled to the door via a hinge defining an axial direction parallel to the vertical direction and the longitudinal plane, the mullion being rotatable about the axial direction between a first position corresponding to the open position of the door and a second position corresponding to the closed position of the door; and a damping assembly formed between the door and the mullion, the damping assembly comprising a stopper wedge fixed to the door, the stopper wedge having a primary face extending vertically and along a nonparallel angle relative to the longitudinal plane, and a mated wedge fixed to the mullion, the mated wedge having a receiving face extending vertically and complementary to the primary face of the stopper wedge to engage therewith in the first position, wherein the stopper wedge further has a secondary face opposite the primary face, and wherein the mated wedge further has a holding face complementary to the secondary face of the stopper wedge to engage therewith in the first position, wherein the stopper wedge and the mated wedge are located between the longitudinal plane of the door and the inner face of the articulating mullion wherein the closed position provides the mated wedge offset from the axial direction along the transverse direction, wherein an open space is defined along a semi-circumferential path about the axial direction between the stopper wedge, including the primary face and the secondary face, and the mated wedge, including the receiving face and the holding face, face in the second position, the open space being traversed by the mated wedge as the receiving face is moved to engagement with the primary face of the stopper wedge in the first position.

* * * * *